US005215290A

United States Patent [19]

Khalessi

[11] Patent Number: 5,215,290

[45] Date of Patent: Jun. 1, 1993

[54] PLASTI FENCE

[76] Inventor: Hamid R. Khalessi, P.O. Box 15664, Sacramento, Calif. 95852

[21] Appl. No.: 885,675

[22] Filed: May 19, 1992

[51] Int. Cl.[5] ..... E04H 17/14

[52] U.S. Cl. ..... 256/19; 256/24; 256/73

[58] Field of Search ..... 256/19, 24, 73

[56] References Cited

U.S. PATENT DOCUMENTS

| | | | |
|---|---|---|---|
| 712,259 | 10/1902 | Carr | 256/24 |
| 3,395,489 | 8/1968 | Banse | 256/24 X |
| 3,454,262 | 7/1969 | Romano | 256/24 X |
| 4,540,160 | 9/1985 | Zanavich et al. | 256/19 |
| 4,722,514 | 2/1988 | Pettit | 256/19 X |
| 4,809,955 | 3/1989 | Veilleux | 256/19 X |

*Primary Examiner*—Andrew V. Kundrat
*Attorney, Agent, or Firm*—John P. Halvonik

[57] ABSTRACT

The invention is an improved fence made of plastic materials and comprising four parts. A central post, removable cap for the post, fence portions and adapter portions for connecting the fence portions with the central post. The adapter portions have bolt holes oriented in three directions to provide a securing arrangement for the fence and post portions.

4 Claims, 6 Drawing Sheets

PLASTI FENCE

FIELD OF INVENTION

BACKGROUND OF THE INVENTION

The invention relates to the field of fences and, in particular, to a plastic fence of four part construction that may be used to join plastic fence posts to the fence portions themselves. In light of the cost of wooden fences, and costs associated with upkeep and deterioration the use of plastic fences is highly desirable. It is thought that plastic fences will be virtually maintenance free and longer lasting than wood fences. With a simple design plastic fences may be manufactured that can be set up quickly and at low cost.

DESCRIPTION OF THE PRIOR ART

While there are plastic fences that are known, none of them use the connective portions to provide secure connection of the posts to the fences. Moreover, none of them provide a system for securing large size portions of walls in order to provide privacy between adjoining yards.

SUMMARY OF THE INVENTION

The invention is a plastic fence of four piece construction including a central post with cap, a fence portion and an adaptive portion for the post and fence connections. The adaptive portions have threaded apertures for placing bolts in several orientations to join the fence into a portion of the connector and to join the connector the central post.

It is an object of the invention to provide a plastic fence that can cover large areas by using a four way intersecting post to connect various fence portions of the fence.

Another object of the invention is to provide a plastic fence that can readily be set up and is of simple and rugged construction.

Yet another objective is to provide a plastic fence with adaptive portions to allow the fence portions to be connected to the posts.

Another is to provide a fence that can placed over undulating ground through the use of connective portions that may be attached at various heights along the post portions.

Still another objective is to provide a plastic fence with hollow portions to provide a lightweight construction.

Another objective is to provide a plastic fence with large size walled portions in order to provide privacy between adjoining yards.

Other objectives of the invention will become apparent to those skilled in the art once the the invention has been shown and described.

DESCRIPTION OF THE PREFERRED EMBODIMENT

Figure 1:
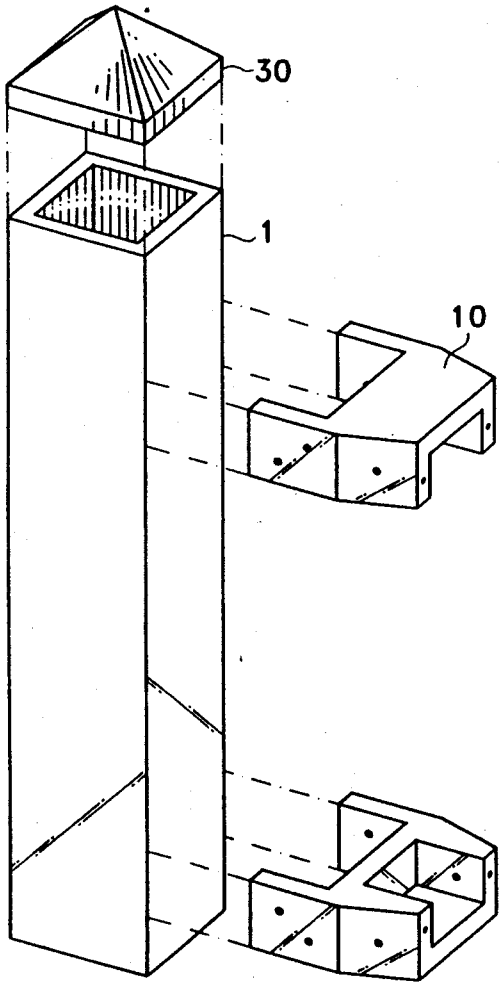
FIG. 1 shows exploded view of each of the fencing system.

The plastic fence of the present application is constructed of three separate parts, each of which serve a specific purpose in the construction of the fence, see FIG. 1. The parts are the post portion 1, the connector portion 10 and the fence portion 20. An optional cap member 30 may be used in connection with the top of the post portion in order to close the open top side of the post.

The fence portions (or walled portions) 20 are used to make barriers between the separate post portions, they provide most of the horizontal distance that the fence encompasses. That is, they are barriers between wherever the posts are set. The fences are also significant in that they may be angled from one post to another to conform to sloping ground.

In their preferred form, the fence portions would be about 6 feet high and perhaps as much as 8 or more feet in length. Along the top and bottom edges of the fence, are tubular portions of preferably square cross section and of hollow construction. For convenience, they are designated the upper 21 and lower 23 rails and they run parallel to one another along the top and bottom edges of the fence. These rails have several purposes. They serve as points on which to secure the fence portions to the connective portions and also function to support the weight of the fence and to offer support for the slat portions 22 that connect the upper and lower rails.

Figure 2:
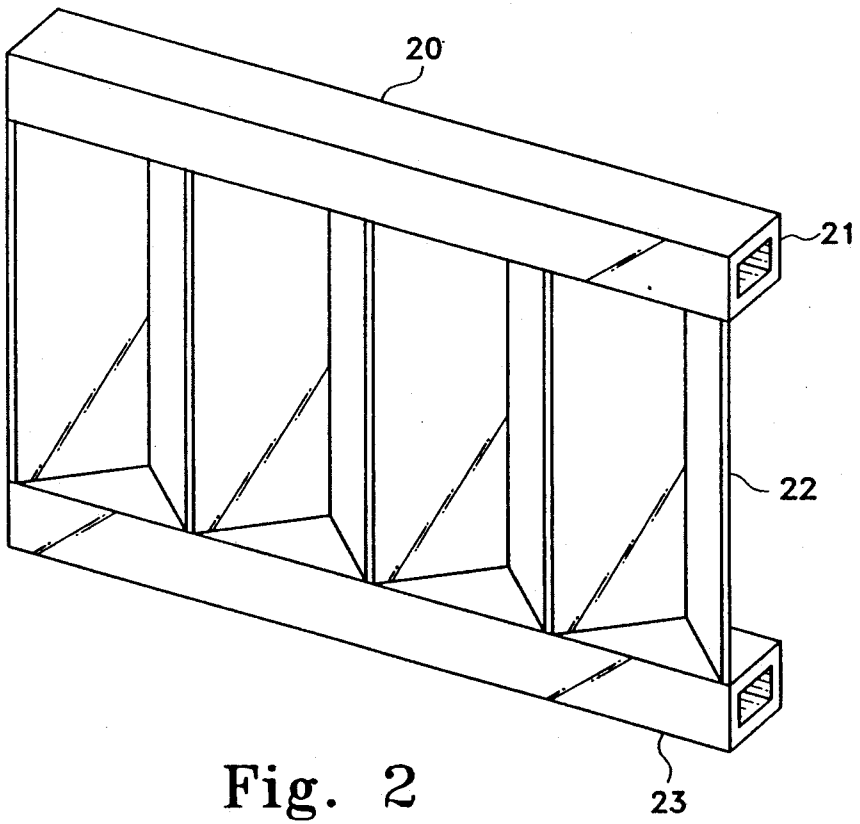
FIG. 2 shows the fence portion.
Figure 8:
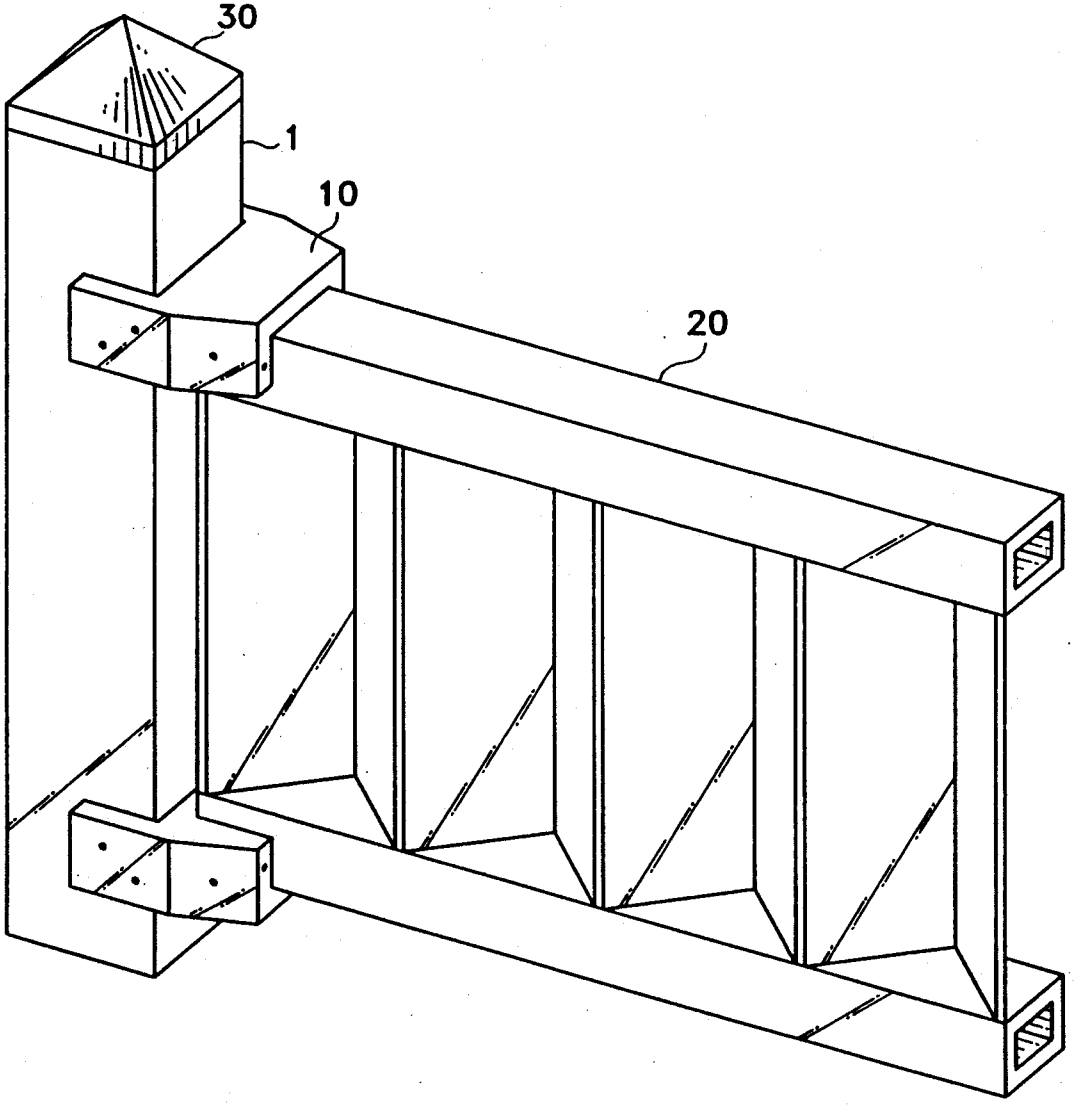
FIG. 8 shows overall construction of the system.
Figure 9:
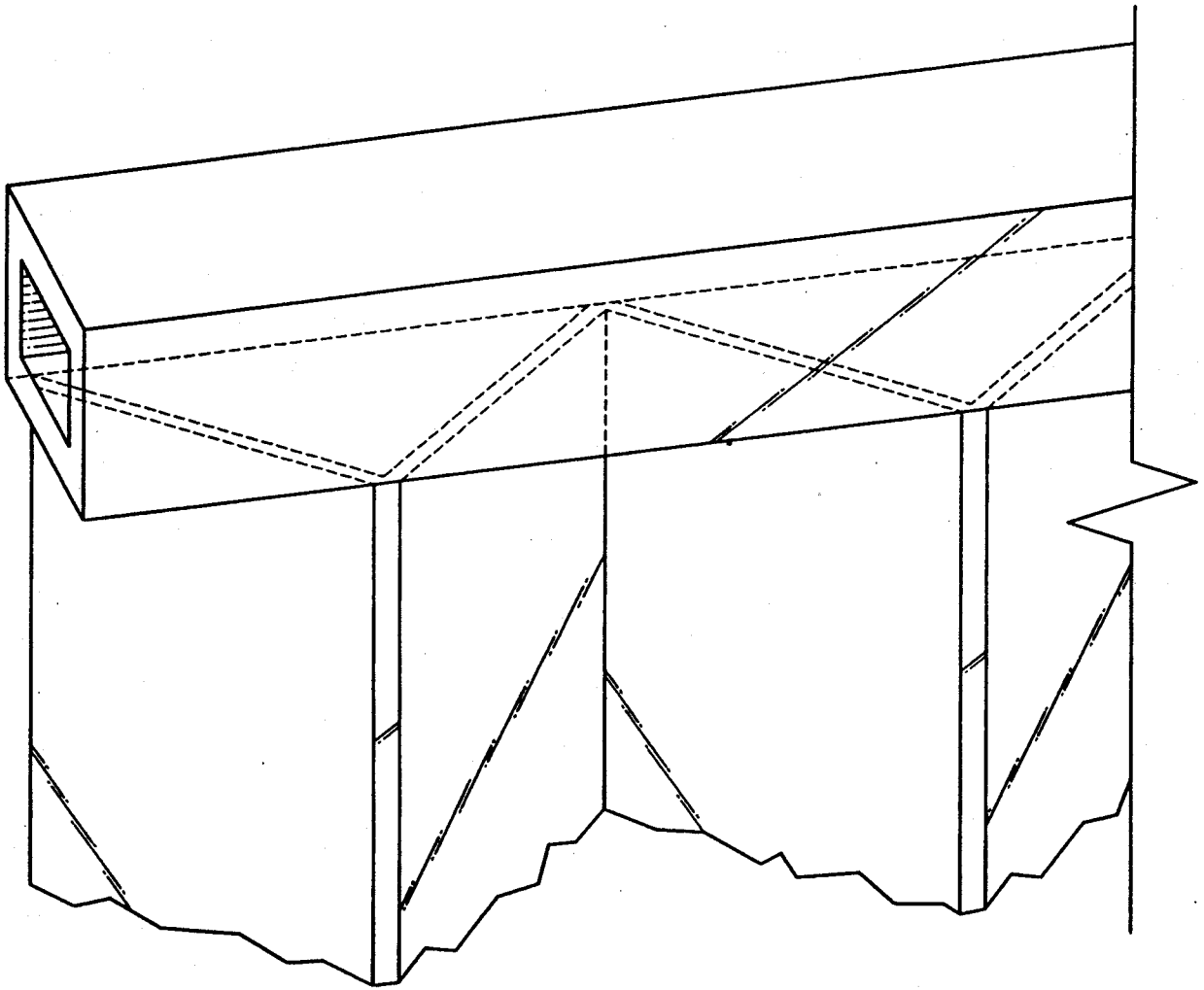
FIG. 9 shows detail of the fence.

The slat portions may be placed so as to alternate in orientation and so give the fence a zig zag appearance, see FIG. 2. A cross section of the rails indicates that they are of square construction and of hollow interior, see FIG. 8.

The post portion is, of course, used to anchor sections of fence to the ground. The post connects to the fence through connecting portions to be described below. It is preferred that the post portions be about 7½ feet in height so that approximately one foot of the height may be secured into the ground leaving a post that will be about 6½ feet above ground when installed. The width of the post should be about 3" by 3" with a generally hollow shape. The use of a post of large height allow fence portions to be secured at various levels along the post to take care of undulations of the ground.

A cap portion 30 may be used to attach to the top of the post and close off the hollow construction from weather, debris etc.

Figure 4:
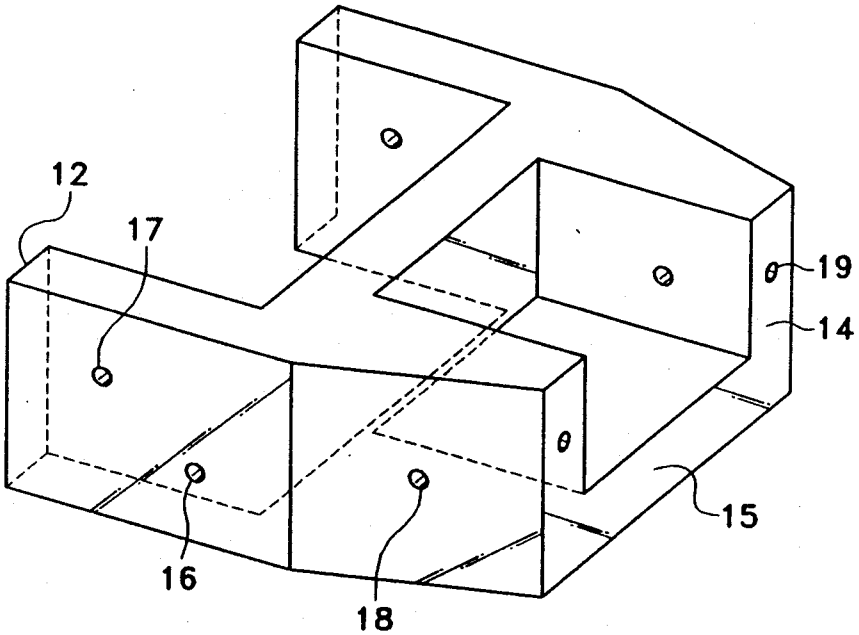
FIG. 4 shows the rear side of the connector piece.
Figure 3:
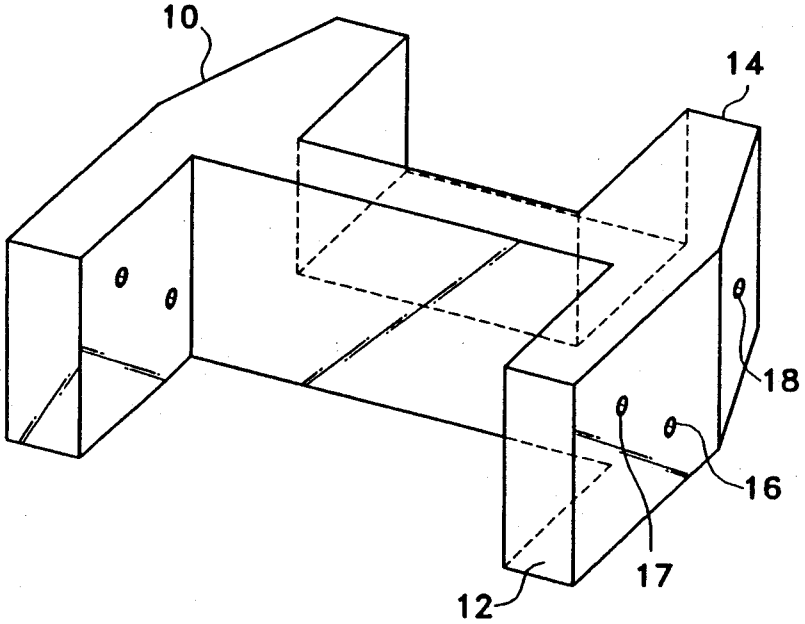
FIG. 3 shows the front side of the connector piece.
Figure 5:
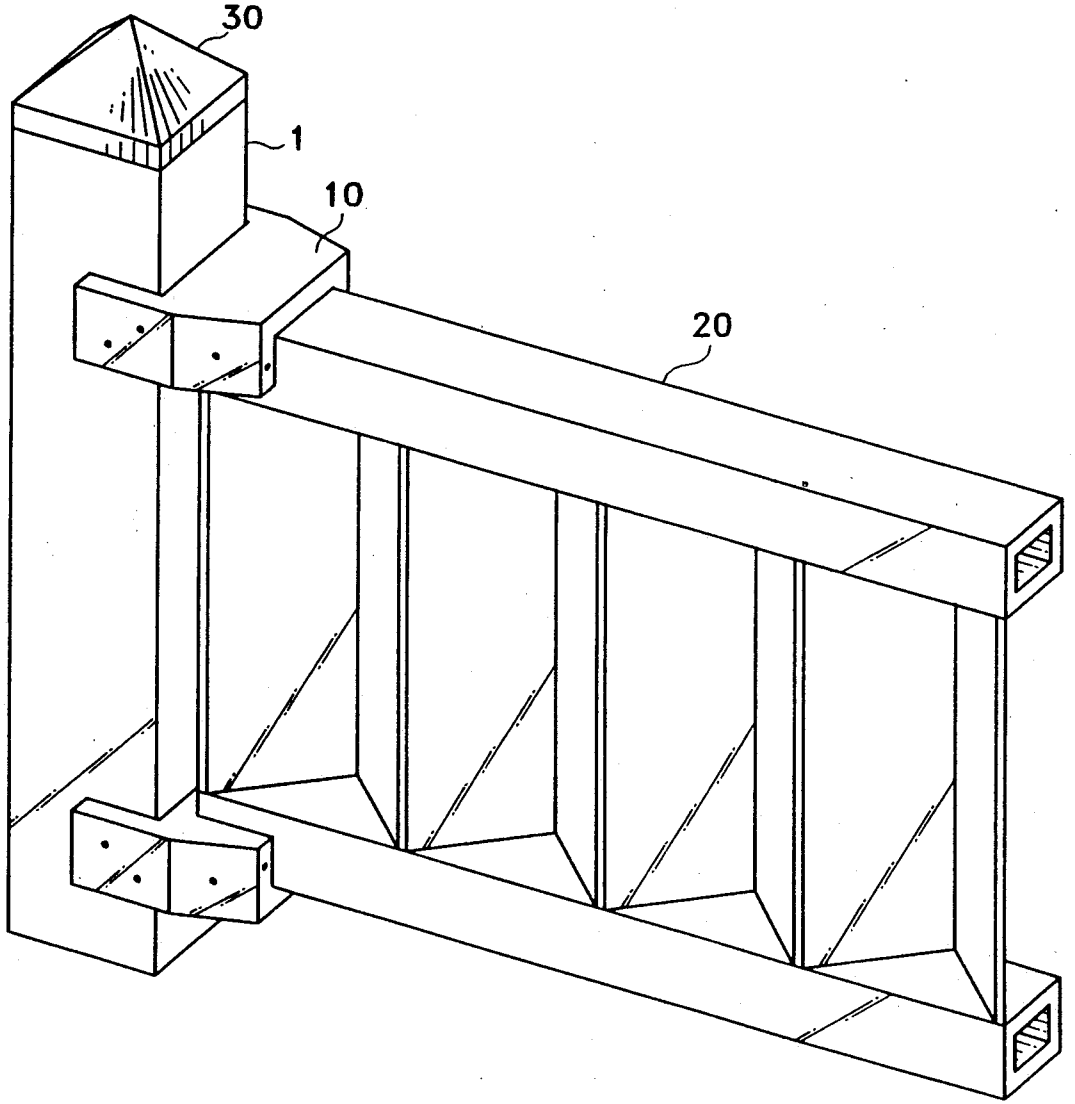
FIGS. 5–7 show positioning of the connector pieces against the post piece.

The connective portions are as shown in FIGS. 3 and 4. The front portion of the connector is symmetrical having two parallel side walls 12. It may be used at the top or at the bottom of the post. This aids in the ability to set the fence up quickly and simply. The front portion attaches to the post. The back portion is shown in FIG. 4 and is attached to each corner of the fence, i.e. there are two connectors at each end of a fence piece to connect the fence to a post (one connector for the top of the fence and one for the bottom). The side walls 12 in the front portion are secured to the post through the use of threaded holes 16 and 17 through which bolts are placed and the connectors secured into place.

Figure 7:
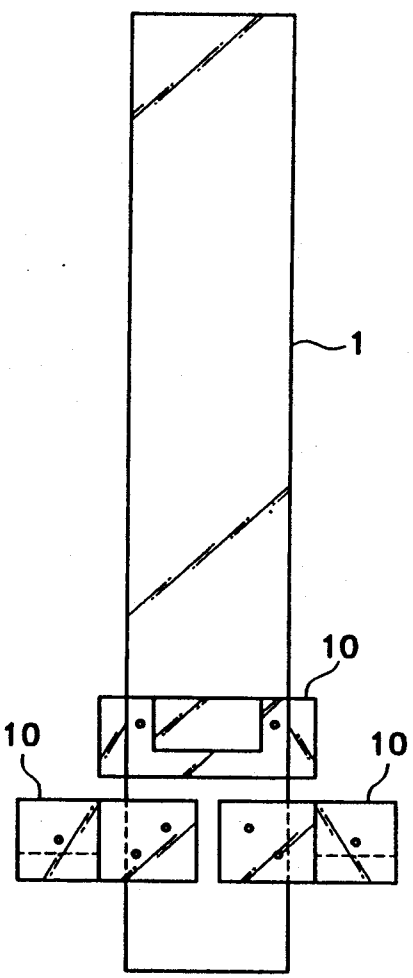
Figure 6:
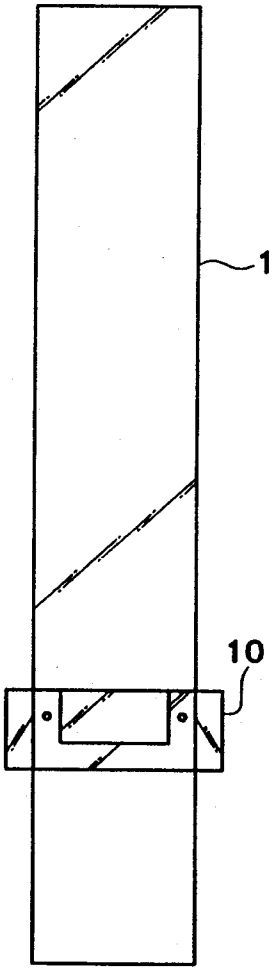
Figure 5:
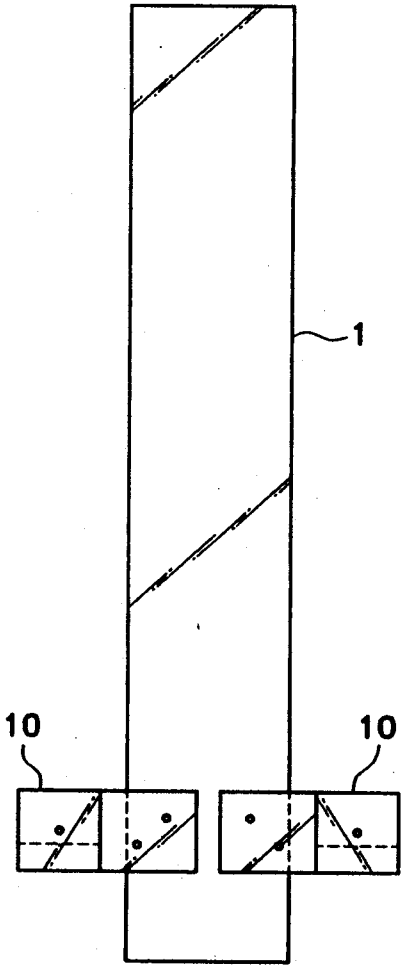

The use of two parallel side walls 12 (and no bottom wall) allows the the front side of the connector to be placed along the post wherever they are desired. Usually the two connectors will not be farther apart on one post than the height of the fence itself. This allows for varying placement of the fence vis a vis the post when the ground is of undulating nature. It also allows for the post to function as a four way intersection for fence pieces as in FIG. 7 which shows how connector portions may be placed at varying vertical distances so that four fences may be attached to one post.

The rear side (FIG. 4) of the connector has a second set of walled portions. On this side, three extending wall portions 14, 15 form a U shaped cross section for fitting around the ends of the rail portions 21, 23. 14 represents the two side walls and 15 represents the bottom wall. The connector is placed at an appropriate position on the post in order to secure either the top rail of the bottom rail of a walled section. At least one threaded hole 18 is located in each side wall 14 and extend into the side of the rails to secure the rails to the connectors. Another set of threaded holes 19 are placed in the front ends of the extended walls 14 and provide for attachment of the connector to the post.

Each connector may be used on either side of the post and at the top or the bottom of the post. This provides interchangeability of the connectors and makes set up easier. One does not have to determine whether a connector piece goes on the top or bottom or the left or right. The system allows one type of connector to fit any position.

To use the fence system of the present invention, the fence portions are laid along the ground and the upper and lower rails attached to the connector portions through bolt holes 18. The connectors are attached at their front side to the post through apertures 16, 17 and 19. The connectors may be moved up or down vertically along the post in order to accommodate the ground that the fence is on. The cap may be used to seal the top of the post.

I claim:

1. An interlocking plastic fence system comprising: post portions of hollow construction and having a square cross section, fence portions for positioning between said post portions, connector portions for connecting said fence portions to said post portions, said connector portions having front and back halves, said front half having left and right side walls extending from said front half and about parallel to one another, said left and right side walls having first set of threaded apertures to allow for attachment of said connector to said post portions, said back half having a U shaped wall extending from said back half, said U shaped wall comprising left and right upright portions and a bottom portion in connection with said left and right portions, said left and right portions having a second set of threaded apertures for securing said fence portions in said U shaped wall.

2. The apparatus of claim 1 wherein said upright portions have a third set of threaded apertures aligned perpendicular to said second set of threaded apertures.

3. The apparatus of claim 2 wherein said fence portions have upper and lower rail portions running in a direction parallel to one another and slat portions connecting said upper and lower rial portions, said upper and lower rail portions of hollow construction and of generally square cross section.

4. The apparatus of claim 3 wherein said posts are about 7½ feet in height.

* * * * *